US006109729A

United States Patent [19]

Desie et al.

[11] Patent Number: 6,109,729

[45] **Date of Patent: *Aug. 29, 2000**

[54] DIRECT ELECTROSTATIC PRINTING DEVICE HAVING A PRINTHEAD STRUCTURE WITH CONTROL ELECTRODES ON ONE SIDE OF A SLIT APERTURE

[75] Inventors: Guido Desie, Herent; Frans Backeljauw, Zwijndrecht, both of Belgium

[73] Assignee: Agfa-Gevaert N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,302

[22] Filed: Dec. 17, 1996

Related U.S. Application Data

[60] Provisional application No. 60/011,555, Feb. 13, 1996.

[30] Foreign Application Priority Data

Dec. 18, 1995 [EP] European Pat. Off. ..... 95203534

[51] Int. Cl.[7] ..... B41J 2/06

[52] U.S. Cl. ..... 347/55

[58] Field of Search ..... 347/55, 112, 141, 347/151; 399/271, 290, 292, 295, 74, 53

[56] References Cited

U.S. PATENT DOCUMENTS 4,491,855 1/1985 Fujii et al. .
4,524,371 6/1985 Sheridon et al. .
4,763,141 8/1988 Gundlach et al. .
5,256,246 10/1993 Kitamura ..... 156/643
5,625,392 4/1997 Maeda ..... 347/55
5,712,670 1/1998 Kagamaya ..... 347/55
5,734,397 3/1998 Maeda ..... 347/55

FOREIGN PATENT DOCUMENTS 6-262796 9/1994 Japan ..... 347/55

*Primary Examiner*—John Barlow
*Assistant Examiner*—C. Dickens
*Attorney, Agent, or Firm*—Baker Botts L.L.P.

[57] ABSTRACT

A Direct Electrostatic Printing (DEP) device is provided that includes a back electrode (105), a printhead structure having an insulating substrate (102), a control electrode (102*a*) and a slit aperture (103) through which a particle flow can be electrically modulated by the control electrode (102*a*), and a toner delivery means (101), in which control electrodes (102*a*) are present only on one side of the slit aperture. In a preferred embodiment the printhead structure is realized by a slit having two sides, side A (SA) and side B (SB), defined by two edges (A and B), which are formed by at least one sheet of insulating material. The insulating material has an elasticity modulus (Young's Modulus, YM) fulfilling the equation 0.1 GPa≦YM≦10 GPa and the edges A and B are placed with respect to each other at an angle α fulfilling the equation 0°≦α<45°.

8 Claims, 7 Drawing Sheets

DIRECT ELECTROSTATIC PRINTING DEVICE HAVING A PRINTHEAD STRUCTURE WITH CONTROL ELECTRODES ON ONE SIDE OF A SLIT APERTURE

This application claims benefit of Provisional Application Serial No. 60/011,555 filed Feb. 13, 1996.

DESCRIPTION

1. Field of the Invention

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure.

2. Background of the Invention

In DEP (Direct Electrostatic Printing) the toner or developing material is deposited directly in an imagewise way on a receiving substrate, the latter not bearing any imagewise latent electrostatic image. The substrate can be an intermediate endless flexible belt (e.g. aluminium, polyimide etc.). In that case the imagewise deposited toner must be transferred onto another final substrate. Preferentially the toner is deposited directly on the final receiving substrate, thus offering a possibility to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

A DEP device is well suited to print half-tone images. The densities variations present in a half-tone image can be obtained by modulation of the voltage applied to the individual control electrodes. In most DEP systems different rows of apertures are used for obtaining an image with a high degree of density resolution (i.e. for producing an image comprising a high amount of differentiated density levels) and spatial resolution.

Printhead structures with multiple rows of apertures have been described in the literature. In U.S. Pat. No. 4,860,036 e.g. a printhead structure has been described consisting of at least 3 (preferentially 4 or more) rows of apertures which makes it possible to print images with a smooth page-wide density scale without white banding. The main drawback of this kind of printhead structure deals with the toner particle application module, which has to be able to provide charged toner particles in the vicinity of all printing apertures with a nearly equal flux. In U.S. Pat. No. 5,040,004 this problem has been tackled by the introduction of a moving belt which slides over an accurately positioned shoe that is placed at close distance from the printhead structure. However, it is evident that a toner application module operated by a friction method cannot provide stable results over long periods of time, due to wear of the belt by the friction of the belt over said shoe.

In U.S. Pat. No. 5,214,451 the problem of providing charged toner particles in the vicinity of all printing apertures with a nearly equal flux, has been tackled by the application of different sets of shield electrodes upon the printhead structure, each shield electrode corresponding to a different row of apertures. During printing the voltage applied to the different shield electrodes corresponding to the different rows of apertures is changed, so that these apertures that are located at a larger distance from the toner application module are tuned for a larger electrostatic propulsion field from said toner application module towards said back electrode structure, resulting in enhanced density profiles.

In U.S. Pat. No. 5,136,311 a charged toner conveyer is described which is stretched over 4 roller bars so that a flat surface is positioned adjacent to said receiving member. In this case no printhead structure is used, but opposite to said receiving member and on the side facing away from said charged toner conveyer an electrode structure is constructed that makes it possible to image-wise jump said charged toner on said charged toner conveyer to said receiving member. In this document no examples are given, but pushing said toner to said receiving member from behind said charged toner conveyer must lead to less accurate control over said toner flow in comparison with apparatus where said toner flow is controlled by a printhead structure which is positioned between said charged toner conveyer and said receiving member.

In European Application 95201048.6 filed on Apr. 25, 1995 an optimized toner application module is described which makes it possible to print images of constant density and quality with printhead structures with multiple rows of apertures. A very compact design of a printhead structure consisting of only two rows of squared apertures is described in this document.

In U.S. Pat. No. 4,491,855 a printhead structure is described consisting of a plastic sheet material with an elongated slit as printing aperture and individual control electrodes on both edges of said slit and on both sides of said plastic material.

The main drawback of this type of printhead structure is the alignment that has to be done between both sheets of plastic material. Since both sheets of plastic material have control electrodes, on both sheets of plastic material driving circuits for the image formation have to be implemented.

As described by Hosaka et al. ("A new ion-jet printing head controlled by a low-voltage signal", SPIE Vol. 2413 pp. 76–86) a bent structure of a single plastic material can be used to implement a printhead structure with on-board driving IC's on both sides of the printing apertures. In FIG. 4 of said article 4 rows of printing apertures are shown, but they can also be replaced with a single printing slit.

Such a construction of a printhead structure for ion-printing as described in the above indicated article poses however problems for implementing in the technique of DEP, because the toner delivery means in the DEP technique is normally much larger than the ion-generating means in the ion-printing technique.

The apparatus described above do solve, to a greater or lesser extent, the problem of providing charged toner particles in an imagewise controlled way to an image receptive member without the drawbacks of a complicated printhead structure or complicated guiding structures.

There is thus still a need for a DEP system comprising a printhead structure yielding images with high density resolution and spatial resolution, and a simple and reliable toner application module without expensive and complex mechanical parts.

OBJECTS AND SUMMARY OF THE INVENTION

It is an object of the invention to provide an improved Direct Electrostatic Printing (DEP) device, printing with high density and high spatial resolution at a high printing speed.

It is a further object of the invention to provide a DEP device combining high spatial and density resolution with good long term stability and reliability.

It is still a further object of the invention to provide a printhead structure for a DEP device, wherein said printhead structure combines a compact design with good long term stability and reliability.

It is another object of the invention to provide an inexpensive charged toner application module which combines a compact design with high printing speed and good long term stability.

Another object of the invention is to provide a DEP device with a printhead structure where clogging of the printing apertures is minimized and where the printing apertures can easily be cleaned.

Further objects and advantages of the invention will become clear from the description hereinafter.

The above objects are realized by providing a printhead structure, for a DEP (Direct Electrostatic Printing) device comprising an insulating material (102), a slit (103), formed by two sides (SA and SB) of said insulating material (102), as printing apertures (103) and control electrodes (102*a*) characterised in that only one of said two sides forming said slit carries control electrodes.

The objects are further realized by providing a DEP device that comprises:

a back electrode (105), a printhead structure, comprising an insulating substrate (102), a control electrode (102*a*) and a slit aperture (103) through which a particle flow can be electrically modulated by said control electrode (102*a*), a toner delivery means (101), characterised in that only on one side of said slit aperture control electrodes (102*a*) are present.

A further embodiment provides a DEP device wherein said slit has two sides (SA and SB), defined by two edges (EA and EB), which are formed by at least one sheet of insulating material, said insulating material has an elasticity modulus (Young's Modulus, YM) fulfilling the equation 0.1 GPa$\leqq$YM$\leqq$10 GPa and said edges A and B are mounted with respect to each other at an angle $\alpha$ fulfilling the equation $0° \leqq \alpha < 45°$.

In a further embodiment said slit is formed by two sheets of insulating material.

In a further embodiment of the invention, a common shield electrode (102*b*) is present on side SB of said slit in addition to said control electrodes (102*a*) present on side SA of said slit.

DETAILED DESCRIPTION OF THE INVENTION

In the literature many devices have been described that operate according to the principles of DEP (Direct Electrostatic Printing). All these devices are able to perform grey scale printing either by voltage modulation or by time modulation of the voltages applied to the control electrodes.

Figure 1:
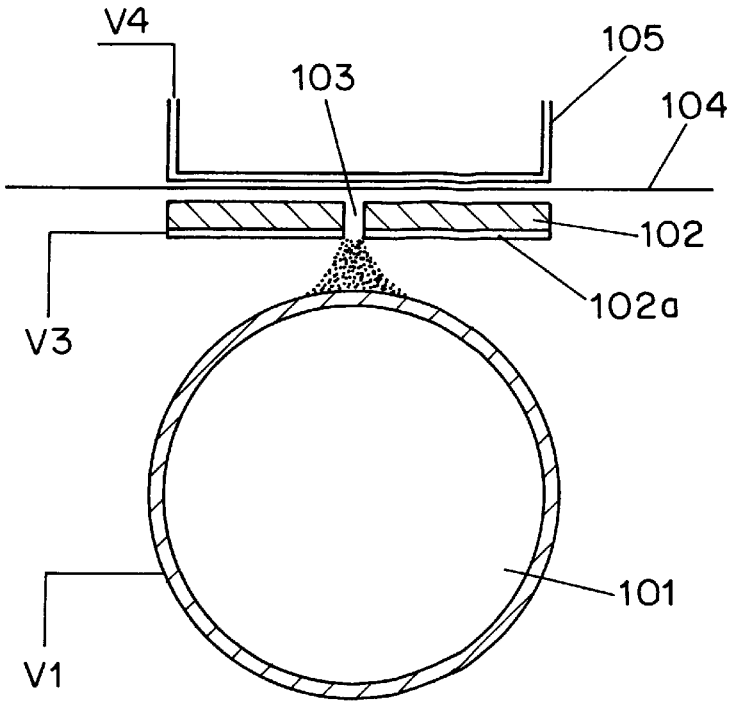
FIG. 1 is a schematic illustration of the essential features of a DEP device.

FIG. 1 shows schematically the essential features of a DEP device, wherein a printhead structure according to the present invention can be used. A toner delivery means (101) delivers toner particles in the vicinity of a printhead structure (102) wherein printing apertures (103) are present. Charged toner particles can pass from the toner delivery means to a toner receiving member (104) in a DC field generated by having the toner delivery means at voltage V1 and a back electrode (105) behind said toner receiving member at a voltage V4. The amount of toner passing through aperture (103) is controlled by applying a voltage V3 to a segmented control electrode (102*a*) around printing aperture (103). When, e.g., a negatively charged toner is used and V1 is 0 V and V4 500 V, the toner particles will flow to the toner receiving member when V3 is held at 0. When V3 is held at −500 V, no toner can pass through the printing aperture (103). With constant printing time, with V3 at 0 V, maximal density is printed, and with V3 at −500 V, minimal density. Keeping V3 at different voltages between 0 and −500 V, intermediate densities can be printed. A DEP device commonly comprises further (not shown in FIG. 1), means to move the toner receiving member (104) past the printing apertures (103) and means to fix the toner image to the toner receiving member.

It has been described above that a problem of DEP devices is that it is necessary to have a printhead structure with several rows of printing apertures to be able to print at high speed and that it is necessary to provide charged toner particles in the vicinity of all printing apertures with a nearly equal flux. This problem has been tackled by the use of a belt as a charged toner conveyer (CTC), because in that case it is possible to provide a flat surface carrying toner particles under the rows of apertures and thus an equal distance between said surface and said printing apertures. The use of a moving belt, however, brings about problems with wear of said belt due to friction over guiding members or with place consuming geometries in order to avoid said friction. In other documents it has been described to use a toner delivery means with a cylindrical shape with large diameter to overcome the drawbacks of a non-constant toner flux towards said different rows of apertures.

The trend in any printing device, and thus also in DEP printing devices is to provide devices that are as small as possible and still perform at high speed. In this view the use of a cylindrical rotating toner delivery means with large diameter is not preferred.

As described in European Application 95200556.9 filed on Mar. 7, 1995 it is also possible to reduce the extension of the printhead structure in order to be able to use a toner delivery means with small diameter. A very compact design of only two rows of square-shaped apertures has been described in this patent application.

Figure 2:
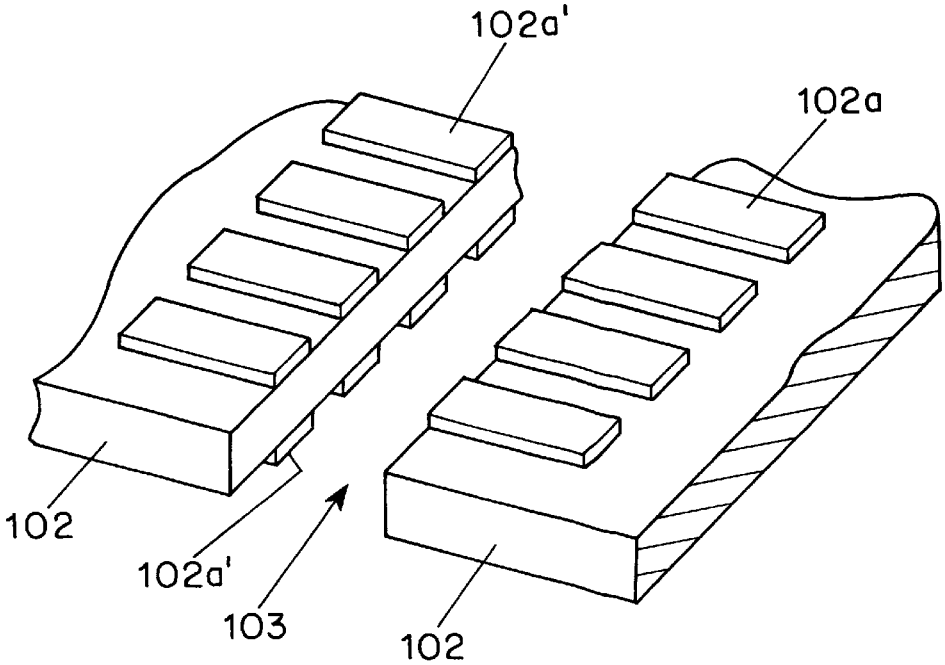
FIG. 2 PRIOR ART
FIG. 2 is a schematic illustration of prior art printhead structures of a DEP device.

In U.S. Pat. No. 4,491,855 a printhead structure with an extremely compact extension, namely a slit aperture has been described. In FIG. 2 this prior art printhead structure is shown. The control electrodes (102*a*) are present on both sides of the slit formed by two edges of insulating material (102) making up the printhead structure and there are also control electrodes (102*a*') present across the printing aperture (slit) (103). To perform high quality printing with such a printhead structure it is necessary that the corresponding control electrodes (102*a* and 102*a*') are very accurately aligned with respect to each other. There is until now no method provided for an easy and inexpensive method of implementing such a printhead structure requiring an extremely accurate alignment of both sides of said flexible substrate over said slit aperture.

All the drawbacks mentioned above can be solved by using a printhead structure having a slit as printing aperture (103) where only on one of the sides of the slit control electrodes that have to be connected to driver IC's are present. Since only one side of the slit carries segmented control electrodes, misalignment between two rows of segmented control electrodes is impossible.

Various printhead structures, being variants on a first embodiment of the present invention, are shown in FIG. 3. In this figure, 102 represents the insulating material, 102*a* represents the complex addressable electrode structure, hereinafter called "control electrodes", 103 the printing aperture (in this case a slit) and arrow TF represents the direction of the toner flow, from the toner delivery means (not shown) to the toner receiving member (not shown). In FIG. 3*a*, the simplest form of the first embodiment of a printhead structure according to the present invention is shown: on one face of the insulating material (102) forming side A (SA) of the slit (103) control electrodes (102*a*) are present. On the insulating material (102) forming the side B (SB) of the slit, no electrodes are present. The control electrodes (102*a*) on side A (SA) of the slit face the toner receiving member as can be seen from the direction of arrow TF, representing the direction of the toner flow, from the toner delivery means (not shown) to the toner receiving member (not shown). In FIG. 3*b*, a variant on the first embodiment of a printhead structure according to the present invention is shown. Again, on one face of the insulating material (102), forming side A (SA) of the slit (103) control electrodes (102*a*) are present. On the insulating material (102) forming the side B (SA) of the slit, a continuous electrode (102*b*), a "shield electrode", is present. The control electrodes (102*a*) on side A (SA) and the control electrode (102*b*) on side B (SB) of the slit both face the toner receiving member as can be seen from the direction of arrow TF, representing the direction of the toner flow, from the toner delivery means to the toner receiving member (not shown). In FIG. 3*c*, a further variant on the first embodiment of a printhead structure according to the present invention is shown. This variant has control electrodes (102*a*) on side A and a shield electrode (102*b*) on side B, as the variant shown in FIG. 3*b*, but now the control electrodes (102*a*) face the toner receiving member (not shown) and the shield electrode (102*b*) faces the toner delivery means. It is clear that each of the printhead structures, shown in FIGS. 3*a* to 3*c*, can be turned upside down. By doing so, the electrode structures, facing the toner delivery means in the FIGS. 3*a* to 3*c*, will then face the toner receiving member and vice-versa.

Figure 3A:
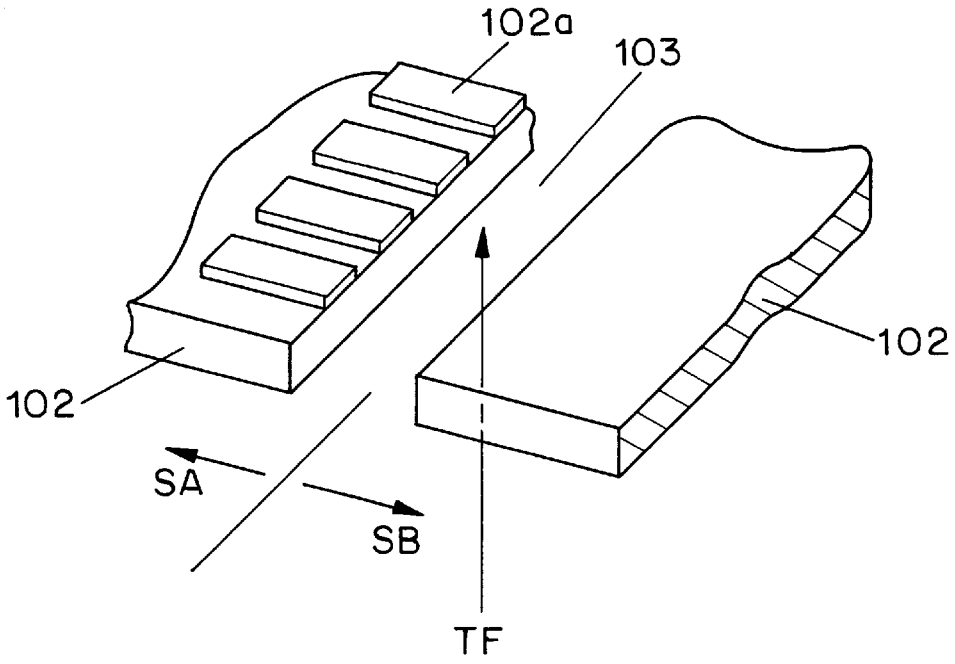
FIG. 3 is a schematic illustration of printhead structures according to a first embodiment of the present invention.
Figure 3B:
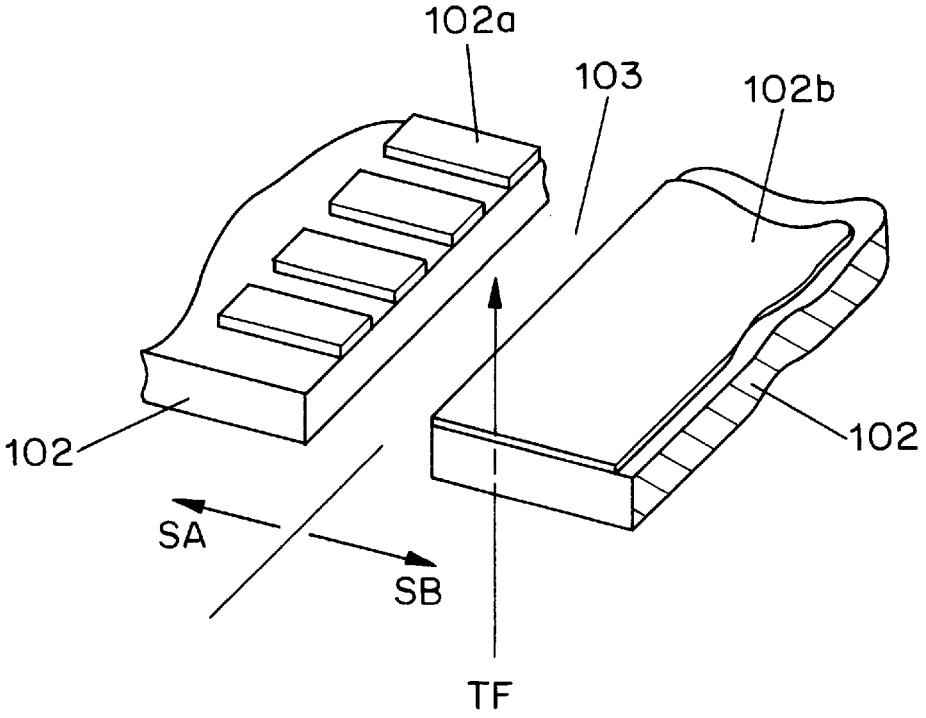
Figure 3C:
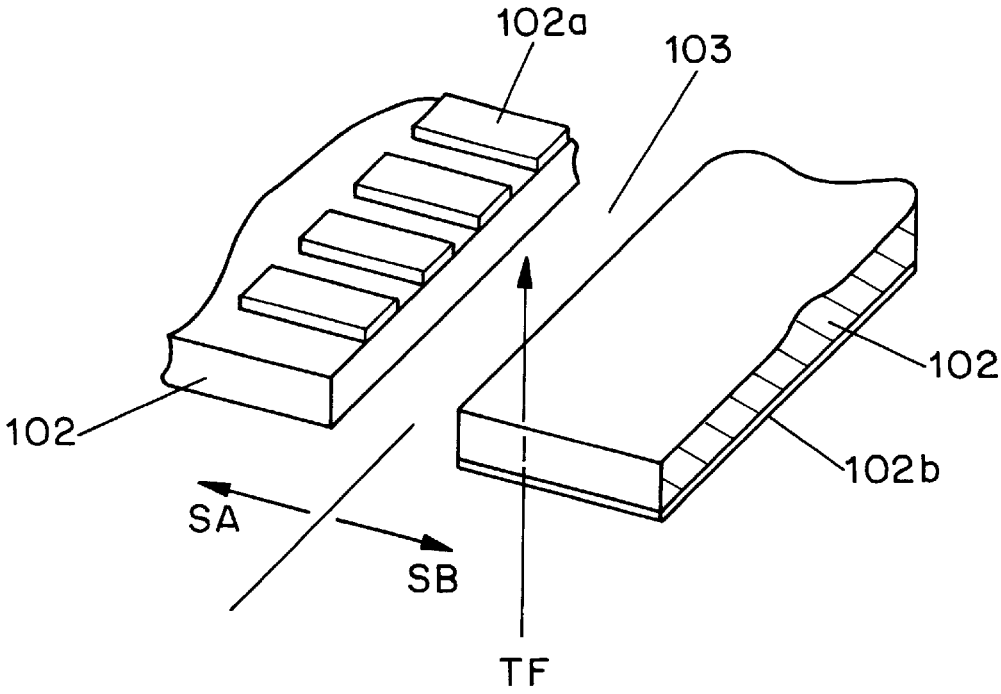
Figure 3D:
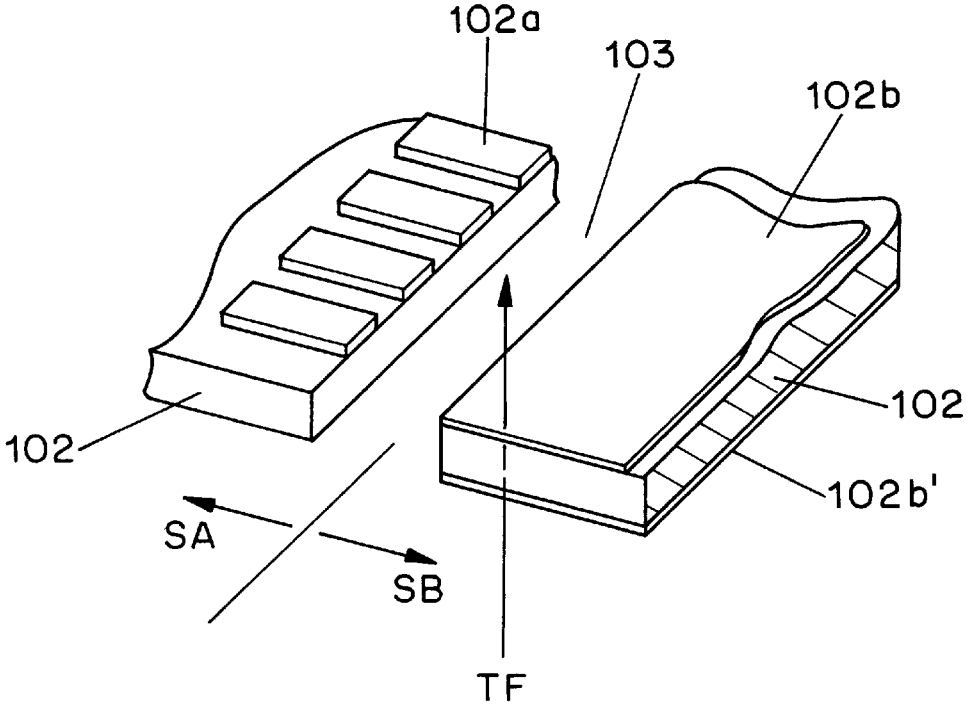

A printhead structure, comprising a shield electrode (102*b*) on both faces of the insulating material forming side B (SB) of the slit (103), and control electrodes (102*a*) on only one face of the insulating material (102), is still another variant on the first embodiment of a printhead structure of the present invention and is shown in FIG. 3*d*. In this figure, the control electrodes (102*a*) face the toner receiving member, it is clear that also a printhead structure, as shown in FIG. 3*d* can be mounted upside down, in such a way the control electrodes (102*a*) face the toner delivery means.

In further variants of a printhead structure, according to the present invention, wherein side A (SA) of the printhead structure carries on one face of the insulating material control electrodes (102*a*), a continuous shield electrode can be present on that face of said insulating material (102) forming side A of the slit of the printhead structure opposite to the face carrying the control electrodes (102*a*).

In FIG. 4 variants on a second embodiment of a printhead structure according to the present invention are shown. FIG. 4*a* shows again the simplest form of a printhead structure according to the second embodiment of the invention. On both faces of the insulating material (102) forming side A (SA) of the slit (103) control electrodes (102*a*) are present. On the insulating material (102) forming the side B (SB) of the slit, no electrodes are present. The control electrodes (102*a*) on both faces of the insulating material forming side A (SA) are located such as to have pairs of control electrodes (102*a*) (one on every face) exactly in register in pairs.

Figure 4A:
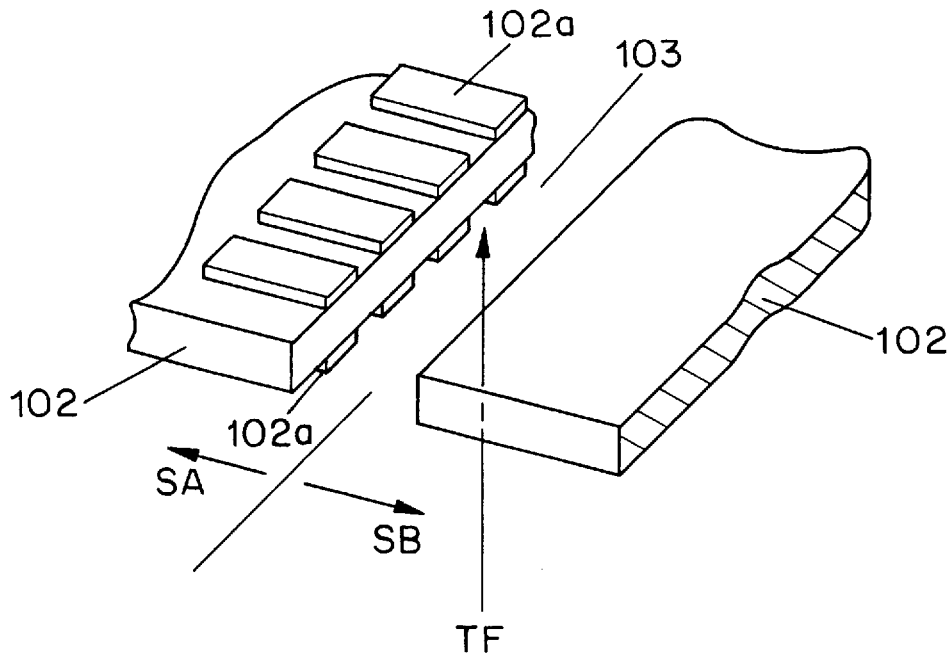
FIG. 4 is a schematic illustration of printhead structures according to a second embodiment of the present invention.
Figure 4B:
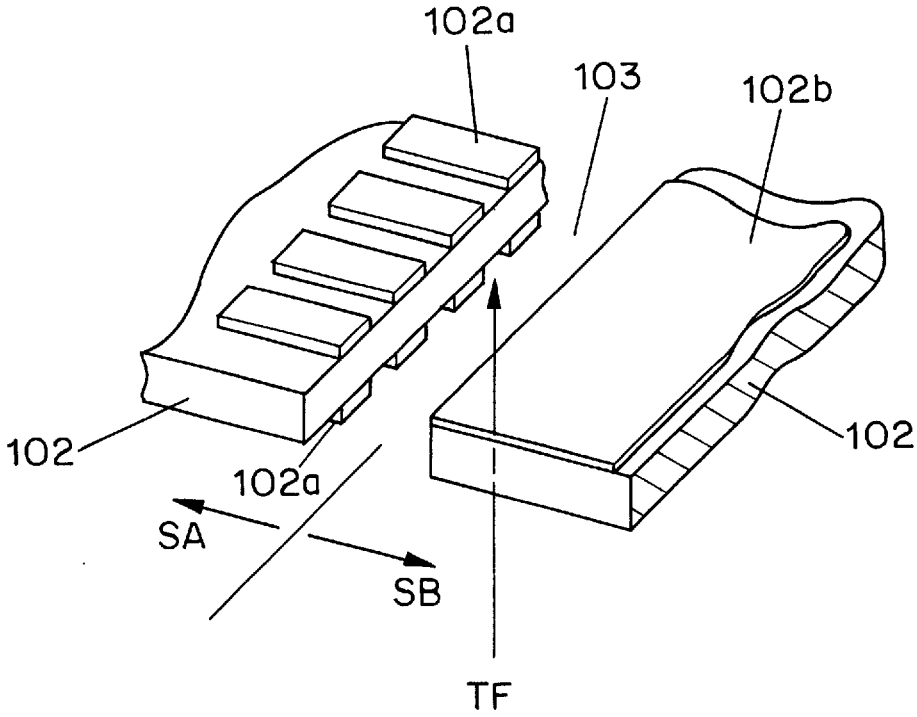
Figure 4C:
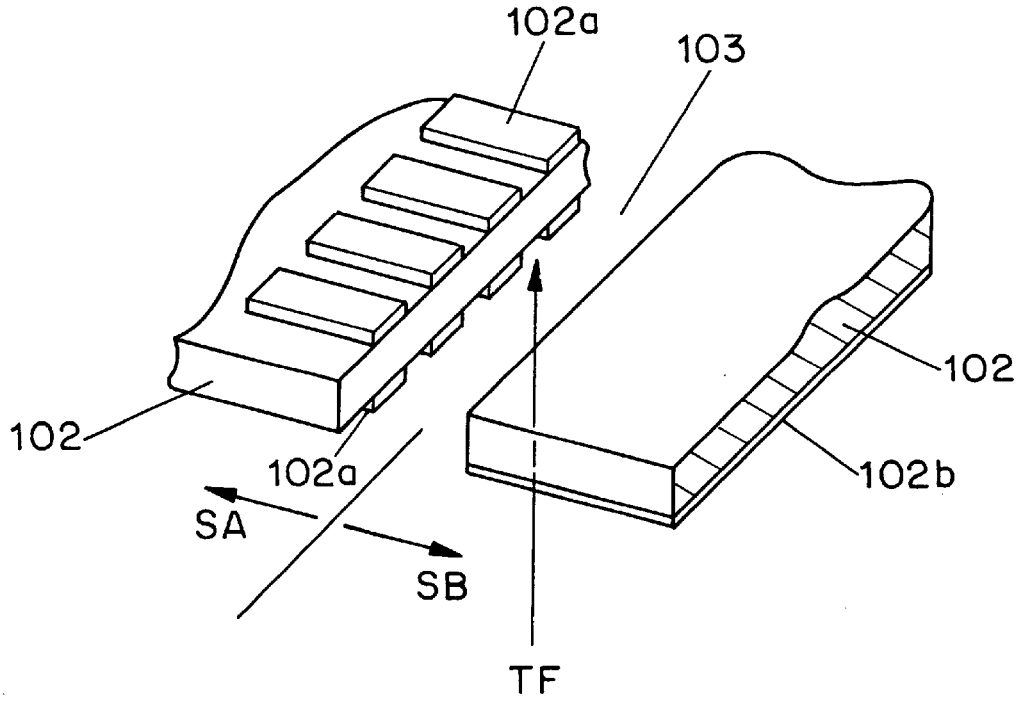
Figure 4D:
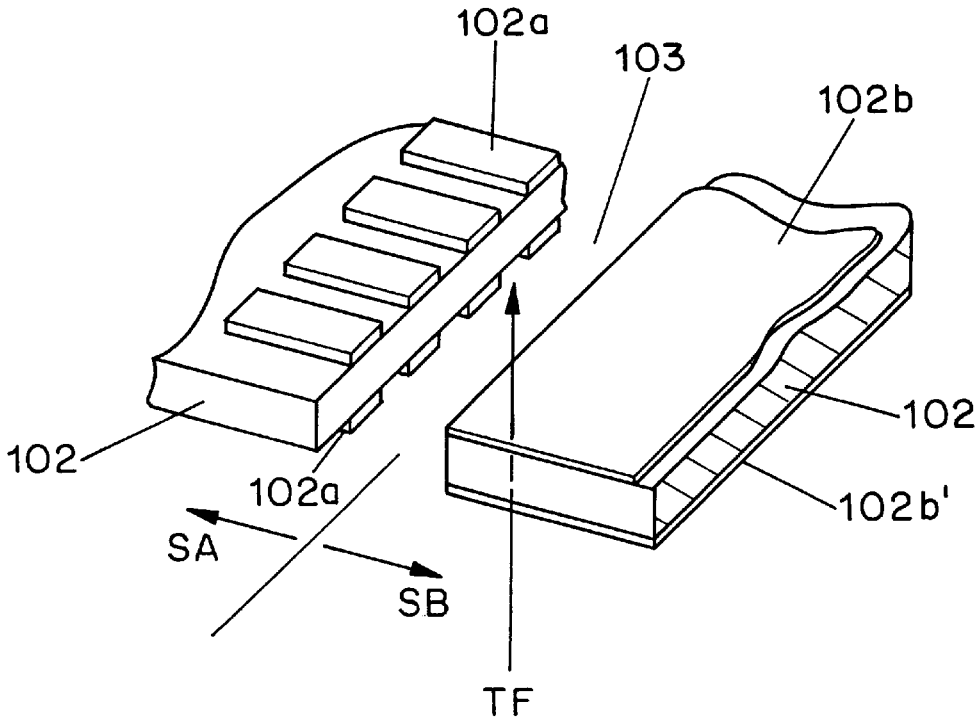

In FIG. 4*b*, another variant on the second embodiment of a printhead structure according to the present invention is shown. Side A (SA) of the printhead structure, shown in FIG. 4*b*, is the same as the one shown in FIG. 4*a*, on the insulating material forming side B (SB), however, a continuous shield electrode (102*b*) is present, facing the toner receiving member, as can be seen from the direction of arrow TF, representing the direction of the toner flow, from the toner delivery means (not shown) to the toner receiving member (not shown). FIG. 4*c*, represents a further variant of a printhead structure according to the second embodiment of the invention, and equals the printhead structure shown in FIG. 4*b*, except for the shield electrode (102*b*), that in this variant faces the toner delivery means. In FIG. 4*d*, still another variant on a printhead structure according to the second embodiment of this invention is shown. Side A (SA) of the printhead structure, shown in FIG. 4*d*, is the same as the one shown in FIG. 4*a*; on both faces of the insulating material forming side B (SB), however, a continuous shield electrode (102*b*) is present.

The control electrodes (102*a*), being present on both faces of the insulating material (102) forming side A (SA) of the slit (103) can, in pairs, be connected to each other via metallisation through said aperture (103), forming a single control electrode. Ways and means for connecting electrodes through printing apertures are known in the art. Examples of such means have been disclosed in European Application 95201939 filed on Jul. 14, 1995

Figure 5A:
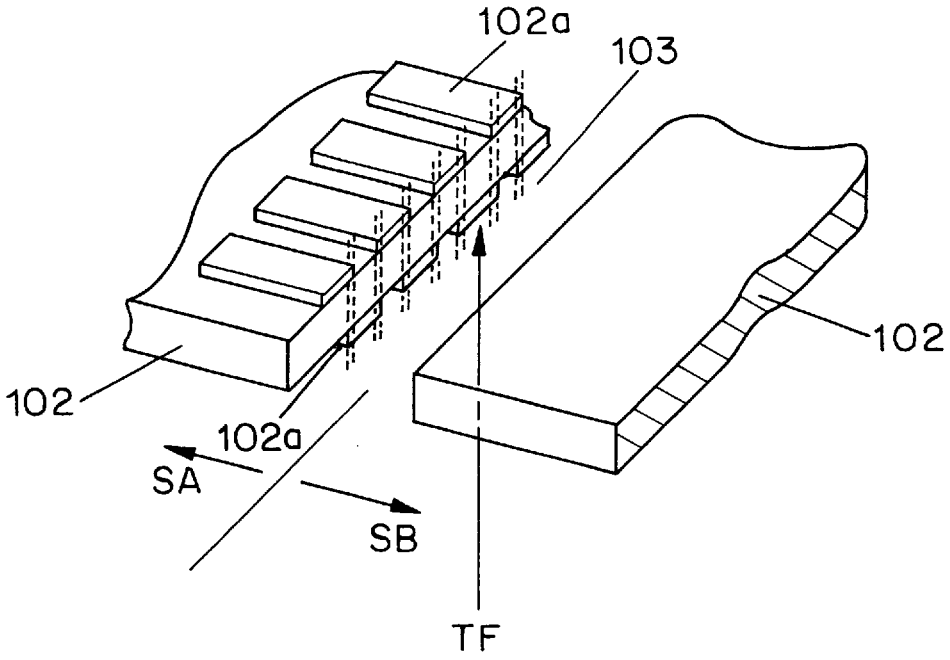
FIG. 5 is a schematic illustration of printhead structures according to a third embodiment of the present invention.
Figure 5B:
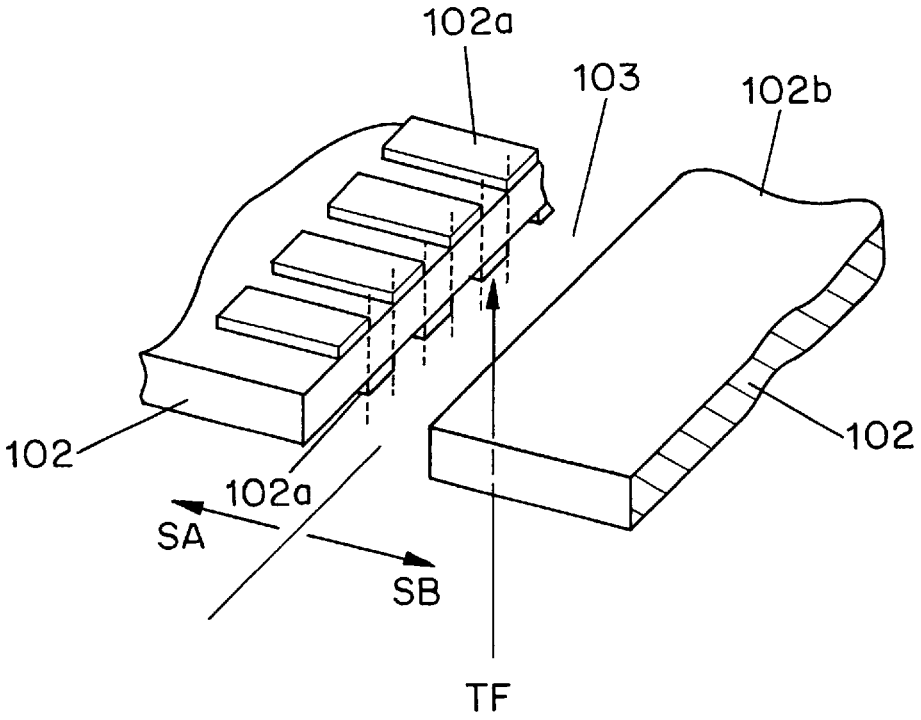

In FIG. 5*a* a variant of a third embodiment of a printhead structure according to the present invention is shown. In FIGS. 5*a* and 5*b*, the control electrodes (102*a*) on both faces of the insulating material forming side A (SA) are staggered. In FIG. 5*a* the width of the control electrodes parallel to the length of the slit (103) is selected such as to have some overlap between the control electrodes on one face of the insulating material (102) and the other. In FIG. 5*b*, the width of the control electrodes parallel to the length of the slit (103) is selected such as to have no overlap between the control electrodes on one face of the insulating material (102) and the other. In FIGS. 5*a* and 5*b*, the printhead structures are shown, with no electrode on the insulating material forming side B (SB) of the printhead structure. It is clear that printhead structures having a side A, as shown in FIGS. 5*a* and 5*b*, can also be used in combination with a side B carrying shield electrode (facing the toner delivery means or facing the toner receiving member) on one face of the insulating material, or with a side B carrying a shield electrode on both faces of the insulating material. The use of printhead structure having a slit as printing apertures and the control electrodes on both faces of the insulating material forming side A (SA) staggered is beneficial for introducing in a DEP device for achieving high resolution prints.

The invention is not restricted to printhead structures wherein side A of the slit is formed by a single film of insulating material whereon on both faces control electrodes are present. It is possible to produce a side A of the slit by superposing several sheets of insulating material and have control electrodes on each interface. In this embodiment the multiple control electrode may be staggered, which clearly enhances the resolution achievable with the printhead structure.

The essence of a printhead structure, according to the present invention, is that it comprises a slit as printing aperture and that only on one side of the slit control electrodes are present. This carries the advantage that, during the mounting of the printhead structure in the DEP device, no particular demands are raised regarding the registering of the insulating materials forming the sides of the slit.

The insulating material, used for producing printhead structure, according to the present invention, can be glass, ceramic, plastic, etc. Preferably said insulating material is a plastic material, and can be a polyimide, a polyester (e.g. polyethylelene terphthalate, polyethylene naphthalate, etc), polyolefines, an epoxy resin, an organosilicon resin, rubber, etc.

The selection of an insulating material for the production of a printhead structure according to the present invention, is governed by the elasticity modulus of the insulating material. Insulating material, useful in the present invention, has an elasticity modulus between 0.1 and 10 GPa, both limits included, preferably between 2 and 8 GPa and most preferably between 4 and 6 GPa.

The insulating material has a thickness between 25 and 1000 $\mu$m, preferably between 50 and 200 $\mu$m.

The slit in a printhead structure according to the present invention can be from 50 to 500 $\mu$m wide. The width can be chosen as dictated by the resolution needed in the final print.

A printhead structure according to any embodiment of the present invention, can be mounted in a DEP device in several ways. Preferably a printhead structure, according to the present invention and carrying only on one side control electrodes, is used, in a DEP device wherein (i) said slit has two sides, side A (SA) and side B (SB), defined by two edges (A and B), which are formed by at least one sheet of insulating material, (ii) said insulating material having an elasticity modulus (Young's Modulus, YM) fulfilling the equation $0.1\ \text{GPa} \leqq YM \leqq 10\ \text{GPa}$, (iii) said edges A and B being placed with respect to each other at an angle $\alpha$ fulfilling the equation $0° \leqq \alpha < 45°$.

Figure 6:
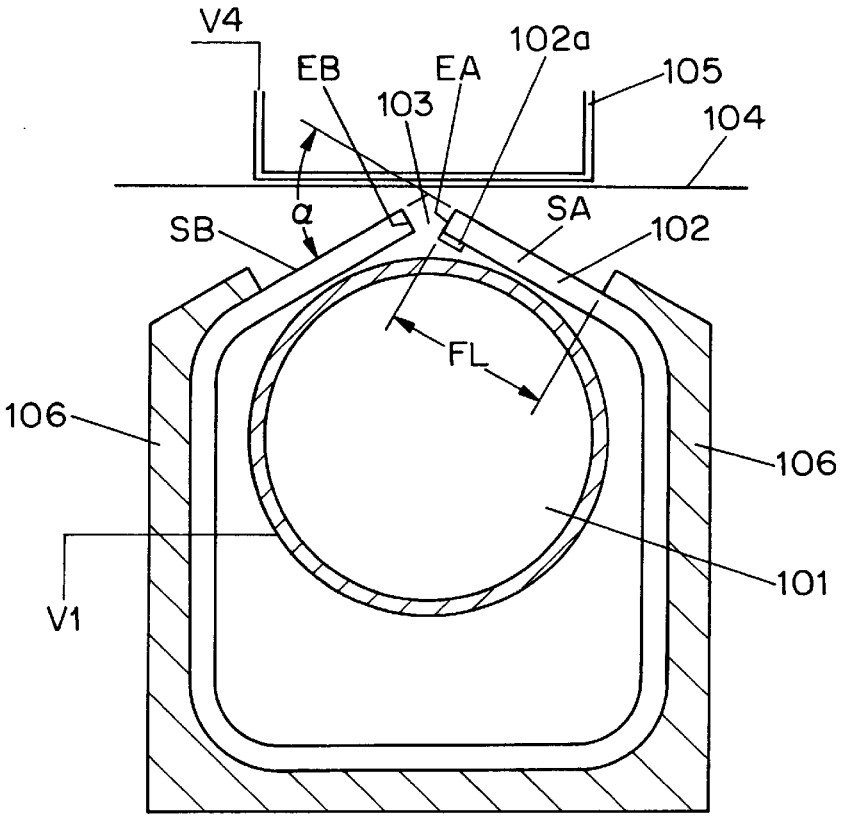
FIG. 6 is a schematic illustration of a specific embodiment of a DEP device, incorporating a printhead structure according to the present invention.
Figure 7:
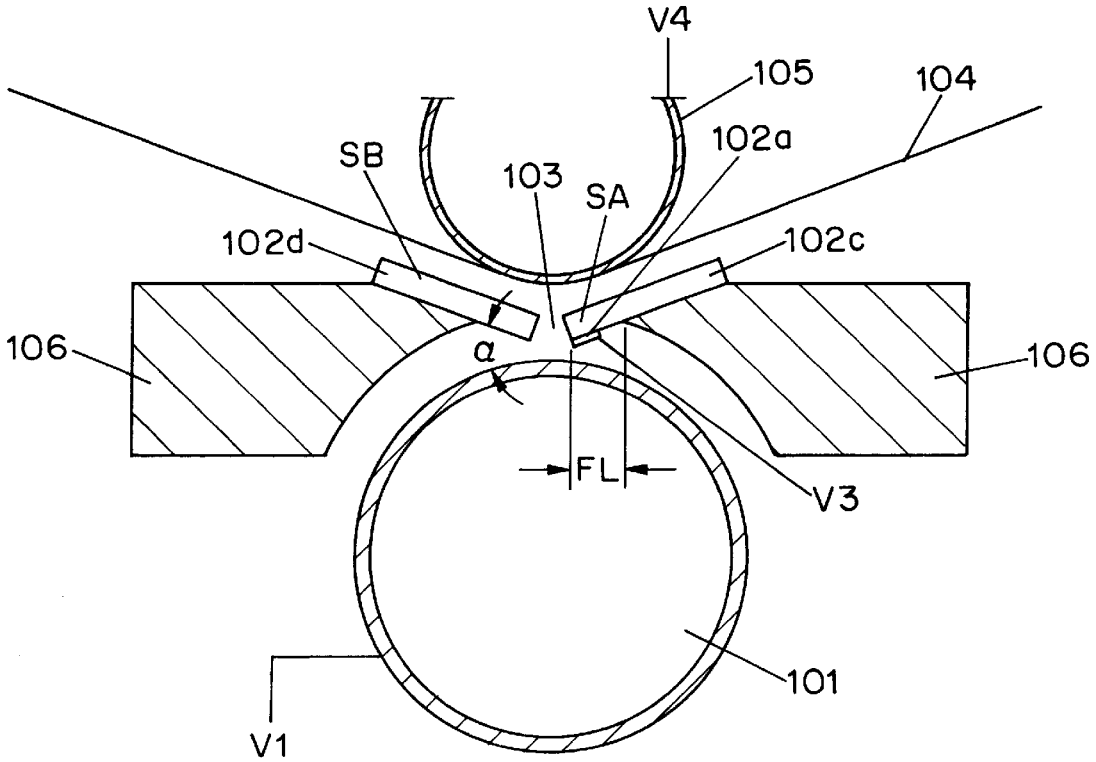
FIG. 7 is a schematic illustration of another specific embodiment of a DEP device, incorporating a printhead structure according to the present invention.

In the FIGS. 6 and 7, specific embodiments of DEP devices, incorporating printhead structures, according to the present invention, are shown In FIG. 6 a DEP device, incorporating a printhead structure according to a variant of the first embodiment of the invention is shown. A toner delivery means (101) is located in a toner container, that is formed by a single sheet of plastic material (102) mounted in a rigid frame (106). Slit (103) is formed by the ends (EA) and (EB) of said single sheet of plastic material (102). Side A (SA) carries control electrodes (102*a*) on one face, facing the toner delivery means (101), side B (SB) carries no electrodes. Sides A and B of the printhead structure are mounted on said rigid frame so that they have a free non-supported length (FL) and that the angle $\alpha$ is greater than or equal to 0° and smaller than 45° and that the edges (EA and EB) protrude in the direction of the back electrode (105) and the toner receiving member (104). Through printing apertures (103), in this case a slit, toner particles are attracted to the toner receiving member (104), by a DC field generated by having the toner delivery means at voltage V1 and a back electrode (105) behind said toner receiving member (104) at a voltage V4. The amount of toner passing through the printing apertures (103) is controlled by applying a voltage V3 to a segmented control electrode (102*a*). Said control electrodes face, in the shown embodiment, the toner delivery means (101). The plastic material, forming side A and side B of the slit, are in contact with the toner delivery means (101).

In FIG. 7, another way of incorporating a printhead structure according to a variant of the first embodiment of the invention is shown. The printhead structure (102) comprises a slit aperture (103). The side A (SA) of the slit, defined by edge A (EA), carries control electrodes (102*a*). Side A (SA) and side B (SB) are, in this specific embodiment of the invention, two separate sheets of plastic (102*c*, 102*d*) mounted on a rigid frame (106), having a free non supported length (FL). The two sheets are mounted such that angle α fulfils the equation $0° \leqq \alpha \leqq 45°$. Through printing apertures (103), in this case a slit, toner particles are attracted to the toner receiving member (104), by a DC field generated by having the toner delivery means at voltage V1 and a back electrode (105) behind said toner receiving member at a voltage V4. The amount of toner passing through the printing apertures (103) is controlled by applying a voltage V3 to a segmented control electrode (102*a*). Said control electrodes face, in the shown embodiment, the toner delivery means in said DEP device. Side B (SB) of the printhead structure (102) does not carry any electrode. The two sheets of plastic material (102*c*, 102*d*) in the printhead structure are bent towards the toner delivery means (101) and contact it so that a controlled pressure is exerted upon said toner delivery means. Said pressure is well controlled by proper adjustment of the angle of both of said sheets of plastic material towards the frame, and by selecting a plastic material with a suitable elasticity modulus (Youngs modulus) and thickness.

When the slit in the printhead structure, according to the present invention is realized by mounting two separate sheets of insulating material (102*c*, 102*d*) to form side A (SA) and side B (SB) of the slit, it is preferred that sheets 102*c* and 102*d* are made of the same material. The insulating material used for forming side A (SA) can be different from the insulating material used for forming side B (SB), as long as both insulating materials fulfil the requirements on the elasticity (Young's modulus) as described hereinbefore. Both insulating materials can have the same or a different thickness.

The form, material and the position of the rigid frame (106) is immaterial for the present invention. Depending on the geometry of the DEP device, the elasticity of the insulating material forming the printhead structure (102), the frame (106) can be located as needed, as long as the value of angle α fulfils the equation $0° \leqq \alpha \leqq 45°$.

In DEP devices, according to the present invention, the angle α is greater than or equal to 0° and less than 45°. In a preferred embodiment said angle varies from 0° to 25° and in a most preferred embodiment said angle varies between 0° and 10°.

A printhead structure according to the present invention is preferably mounted in the DEP device so that the insulating material forming the printhead structure contacts the surface of the toner delivery means, as illustrated in FIGS. 6 and 7. It is however possible to mount a printhead structure according to the present invention in a DEP device so that no contact between the insulating material forming the printhead structure and the surface of the toner delivery means is present.

Although, in FIGS. 6 and 7, only printhead structures according to the first embodiment of the invention are shown in the DEP device, every variant on the three embodiments of the present invention can be incorporated in a DEP device.

The toner delivery means (101) used in DEP devices using a printhead structure according to the present invention may be a CTC (charged toner conveyer) bringing toner particles in the vicinity of the slit (printing aperture) (103) and said toner particles can be brought to the CTC by a magnetic brush. It is also possible to use a printhead structure according to the present invention in a DEP device wherein the toner particles are directly extracted from a magnetic brush (the magnetic brush being then the toner delivery means). A DEP device wherein the toner particles are directly extracted from a magnetic brush has been disclosed in EP-A 675 417, that is incorporated herein by reference.

The back electrode (105) of this DEP device can also be made to cooperate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

Between said printhead structure and the charged toner conveyer (101) as well as between the control electrode facing the slit aperture (103) and the back electrode (105) behind the toner receiving member (104) as well as on the single electrode surface or between the plural electrode surfaces of said printhead structure different electrical fields are applied. In the specific embodiment of a device, useful for a DEP method, using a printing device with a geometry according to the present invention, shown in FIG. 6. Voltage V1 is applied to the sleeve of the charged toner conveyer (CTC) (101), voltages $V3_0$ up to $V3_n$ for the control electrode (102*a*) on side A (SA) of the slit of said printhead structure and facing the single slit aperture 103. The value of V3 is selected, according to the modulation of the image forming signals, between the values $V3_0$ and $V3_n$, on a time basis or grey-level basis. Voltage V4 is applied to the back electrode (105) behind the toner receiving member (104). In other embodiments of the present invention, where a shield electrode is present on side B (SB) of the slit of the printhead structure, Voltage V2 is applied to the shield electrode. In other embodiments, not only V3 is varied between $V3_0$ and $V3_n$, also multiple voltages $V2_0$ to $V2_n$ and/or $V4_0$ to $V4_n$ can be used. When the toner particles are brought on a CTC by a magnetic brush, voltage V5 is applied to the surface of the sleeve of the magnetic brush. When no shield electrode is present, there is no voltage V2.

A DEP device according to the present invention can be operated successfully when a single magnetic brush is used in contact with the CTC to provide a layer of charged toner on said CTC. The device can also be operated when the toner particles are directly extracted from a magnetic brush.

In a DEP device according to the present invention an additional AC-source can be connected to the sleeve of the magnetic brush when the magnetic brush is used to bring the toner particles on a CTC as well as when the toner particles are directly extracted from a magnetic brush.

The magnetic brush preferentially used in a DEP device according to the present invention, when the magnetic brush is used to bring the toner particles on a CTC as well as when the toner particles are directly extracted from a magnetic brush, is of the type with stationary core and rotating sleeve.

In a DEP device, according to the present invention and using a magnetic brush of the type with stationary core and rotating sleeve, any type of known carrier particles and toner particles can successfully be used. It is however preferred to use "soft" magnetic carrier particles. "Soft" magnetic carrier particles useful in a DEP device according to a preferred embodiment of the present invention are soft ferrite carrier particles. Such soft ferrite particles exhibit only a small amount of remanent behaviour, characterised in coercivity values ranging from about 50 up to 250 Oe. Further very useful soft magnetic carrier particles, for use in a DEP device according to a preferred embodiment of the present invention, are composite carrier particles, comprising a resin binder and a mixture of two magnetites having a different particle size as described in EP-B 289 663. The particle size of both magnetites will vary between 0.05 and 3 μm. The carrier particles have preferably an average volume diameter ($d_{v50}$) between 10 and 300 μm, preferably between 20 and 100 μm. More detailed descriptions of carrier particles, as mentioned above, can be found EP 675 417, that is incorporated herein by reference.

It is preferred to use in a DEP device according to the present invention, toner particles with an absolute average charge (|q|) corresponding to 1 fC≦|q|≦20 fC, preferably to 1 fC≦|q|≦10 fC. The absolute average charge of the toner particles is measured by an apparatus sold by Dr. R. Epping PES-Laboratorium D-8056 Neufahrn, Germany under the name "q-meter". The q-meter is used to measure the distribution of the toner particle charge (q in fC) with respect to a measured toner diameter (d in 10 μm). From the absolute average charge per 10 μm (|q|/10 μm) the absolute average charge |q| is calculated. Moreover it is preferred that the charge distribution, measured with the apparatus cited above, is narrow, i.e. shows a distribution wherein the coefficient of variability (ν), i.e. the ratio of the standard deviation to the average value, is equal to or lower than 0.33. Preferably the toner particles used in a device according to the present invention have an average volume diameter ($d_{v50}$) between 1 and 20 μm, more preferably between 3 and 15 μm. More detailed descriptions of toner particles, as mentioned above, can be found in EP 675 417, that is incorporated herein by reference. A DEP device including a printhead structure according to the present invention can function by using single component magnetic toners, with two component developers where the toner particles are charged by triboelectric contact with carrier particles and also with non magnetic mono component development systems. To achieve the last mode of development, it is possible to select the insulating material, forming the printhead structure, such as to have specific tribo electric properties, or to coat said insulating material to give it specific tribo electric properties. When this is done toner particles, on a rotating toner supply roller can be in rotating contact with said insulating material, forming the printhead structure, and be charged by that contact. The use of a non magnetic mono component system as explained immediately above, it is possible to produce a very compact and less expensive DEP device.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage V3 applied on the control electrode 102*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution and of the multiple grey level capabilities typical for DEP, opens the way for multilevel halftoning techniques, such as e.g. described in the European patent application number 94201875.5 filed on Jun. 29, 1994 with title "Screening method for a rendering device having restricted density resolution". This enables the DEP device, according to the present invention, to render high quality images.

EXAMPLES

Throughout the printing examples, the same developer, comprising toner and carrier particles was used.

The Carrier Particles

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The Toner Particles

The toner used for the experiment had the following composition: 97 parts of a co-polyester resin of fumaric acid and bispropoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following formula: $(CH_3)_3N^+C_{16}H_{33}Br^-$ was added in a quantity of 0.5% with respect to the binder, as described in WO 94/027192. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The average particle size was measured by Coulter Counter model Multisizer (tradename), was found to be 6.3 μm by number and 8.2 μm by volume. In order to improve the flowability of the toner mass, the toner particles were mixed with 0.5% of hydrophobic colloidal silica particles (BET-value 130 $m^2/g$).

The Developer

An electrostatographic developer was prepared by mixing said mixture of toner particles and colloidal silica in a 4% ratio (w/w) with carrier particles. The triboelectric charging of the toner-carrier mixture was performed by mixing said mixture in a standard tumbling set-up for 10 min. The developer mixture was run in the magnetic brush for 5 minutes, after which the toner was sampled and the triboelectric properties were measured, according to a method as described in the above mentioned European application 94201026.5, filed on Apr. 14, 1994. The average charge, q, of the toner particles was −7.1 fC.

The Toner Delivery Means

The toner delivery means comprised a cylindrical charged toner conveyer with a sleeve made of aluminium with a TEFLON (trade name) coating an a surface roughness of 2.5 μm (Ra-value measured according to ANSI/ASME B46.1-1985) and a diameter of 20 mm. The charged toner conveyer was rotated at a speed of 50 rpm. The charged toner conveyer was connected to an AC power supply with a square wave oscillating field of 600 V at a frequency of 3.0 kHz with 20 V DC-offset.

Charged toner was propelled to this conveyer from a stationary core/rotating sleeve type magnetic brush comprising two mixing rods and one metering roller. One rod was used to transport the developer through the unit, the other one to mix toner with developer.

The magnetic brush was constituted of the so called magnetic roller, which in this case contained inside the roller assembly a stationary magnetic core, having three magnetic poles with an open position (no magnetic poles present) to enable used developer to fall off from the magnetic roller (open position was one quarter of the perimeter and located at the position opposite to said CTC.

The sleeve of said magnetic brush had a diameter of 20 mm and was made of stainless steel roughened with a fine grain to assist in transport (Ra=3 μm measured according to ANSI/ASME B46.1-1985) and showed an external magnetic field strength in the zone between said magnetic brush and said CTC of 0.045 T, measured at the outer surface of the sleeve of the magnetic brush.

A scraper blade was used to force developer to leave the magnetic roller. On the other side a doctoring blade was used to meter a small amount of developer onto the surface of said magnetic brush. The sleeve was rotating at 100 rpm, the internal elements rotating at such a speed as to conform to a good internal transport within the development unit. The magnetic brush was connected to a DC power supply of −200 V.

In EXAMPLES 1 to 12, a printhead structure according to the first embodiment of the present invention is used, a schematically illustrated in FIG. 6.

EXAMPLE 1

A first sheet (sheet A) of plastic material (50 μm thick polyimide) was provided with individual control electrodes of 85 μm width and isolated from each other by a 85 μm broad isolation zone. Said control electrodes were covered by a second layer of polyimide of 50 μm thickness. A second sheet (sheet B) of plastic material was made from 50 μm thick polyimide with a 8 μm thick continuous copper layer, said copper layer facing the toner delivery means. Both layers were mounted upon a PVC frame with an angle $\alpha$=15° and with a non-supported free length (FL) of 20 mm. The two sheets were separated with a slit of 150 μm. The first one of said plastic sheets with the control electrodes and double polyimide layers was placed at a position so that the surface of the charged toner conveyor was rotating from said first sheet of plastic with double layer of polyimide and copper electrodes, over said printing aperture slit, towards said polyimide sheet of 50 μm thickness with a continuous copper layer. Each of said control electrodes was individually addressable from a high voltage power supply.

For the fabrication process of the printhead structure, conventional methods of copper etching were used, as known to those skilled in the art.

The printhead structure that consists of two separate plastic sheets is touching the sleeve of the charged toner conveyer. The distance between the back electrode and the back side of the printhead structure was set to 150 μm and the paper travelled at 1 cm/sec. To the individual control electrodes an (imagewise) voltage V3 between 0 V and −300 V was applied. The back electrode 105 was connected to a high voltage power supply of +600 V. To the sleeve of the CTC an AC voltage of 600 V at 3.0 kHz was applied, with 20 V DC offset.

EXAMPLE 2

Example 1 was repeated, except that for the second sheet (sheet B) of plastic material a polyimide film of 50 μm thickness without any continuous copper layer was used. All other parameters were equivalent to the ones mentioned in example 1.

EXAMPLE 3

Example 1 was repeated, except that for the second sheet (sheet B) of plastic material a polyimide film of 50 μm thickness with continuous copper layer of 8 μm thickness was used. The copper side of said second sheet of plastic material was facing the back electrode. All other parameters were equivalent to the ones mentioned in example 1.

EXAMPLE 4

Example 1 was repeated, except that for the second sheet (sheet B) of plastic material a polyimide film of 50 μm thickness with continuous copper layer of 8 μm thickness on both sides was used. All other parameters were equivalent to the ones mentioned in example 1.

EXAMPLE 5

Example 1 was repeated, except for the structure of the first sheet (sheet A) of plastic material comprising control electrodes, said sheet of plastic material of 125 μm thickness having 8 μm thick copper control electrodes facing the back electrode. The angle of both of said sheets of plastic material towards said plastic frame was set to 10° and FL was 50 mm.

EXAMPLE 6

Example 2 was repeated, except for the structure of the first sheet (sheet A) of plastic material comprising control electrodes, said sheet of plastic material of 125 μm thickness having 8 μm thick copper control electrodes facing the back electrode. The angle of both of said sheets of plastic material towards said plastic frame was set to 10° and FL was 50 mm.

EXAMPLE 7

Example 3 was repeated, except for the structure of the first sheet (sheet A) of plastic material comprising control electrodes, said sheet of plastic material of 125 μm thickness having 8 μm thick copper control electrodes facing the back electrode. The angle of both of said sheets of plastic material towards said plastic frame was set to 10° and FL was 50 mm.

EXAMPLE 8

Example 4 was repeated, except for the structure of the first sheet (sheet A) of plastic material comprising control electrodes, said sheet of plastic material of 125 μm thickness having 8 μm thick copper control electrodes facing the back electrode. The angle of both of said sheets of plastic material towards said plastic frame was set to 10° and FL was 50 mm.

EXAMPLE 9

Example 5 was repeated except for the fact that the control electrodes faced the toner delivery means.

EXAMPLE 10

Example 6 was repeated except for the fact that the control electrodes faced the toner delivery means.

EXAMPLE 11

Example 7 was repeated except for the fact that the control electrodes faced the toner delivery means.

EXAMPLE 12

Example 8 was repeated except for the fact that the control electrodes faced the toner delivery means.

In EXAMPLES 13 to 16, a printhead structure according to the second embodiment of the present invention is used, as schematically illustrated in FIG. 7.

EXAMPLE 13

In example 13 according to the second embodiment of the present invention, a printhead structure was made with control electrodes on both sides of sheet A of the printhead structure. Sheet A of plastic material was 125 μm thick and had 8 μm thick copper control electrodes on both sides. Sheet B of the printhead structure was a polyimide layer of 50 μm thickness and comprised a continuous copper layer of 8 μm thickness (a shield electrode) facing the toner delivery means. The other parameters were equal to those used in example 5.

EXAMPLE 14

Example 13 was repeated, except that for the second sheet (sheet B) of plastic material a polyimide film of 50 μm thickness without any continuous copper layer was used.

EXAMPLE 15

Example 13 was repeated, except that for the second sheet (sheet B) of plastic material a polyimide film of 50 μm thickness with continuous copper layer of 8 μm thickness was used. The copper side of said second sheet of plastic material was facing the back electrode.

EXAMPLE 16

Example 13 was repeated, except that for the second sheet (sheet B) of plastic material a polyimide film of 50 μm thickness with continuous copper layer of 8 μm thickness on both sides was used.

It has been possible to print images of good density and sharpness irrespective of which of the printhead structures (described in the examples above) was used. The contrast (or voltage source needed to obtain a good contrast) could be optimised by appropriate localisation of the continuous electrode layer in said second sheet of plastic material of said printhead structure. In example 1 a better image homogeneity was obtained if compared with example 2 but a lower image contrast.

What is claimed is:

1. A device for direct electrostatic printing on a substrate, comprising:

a back electrode disposed on one side of said substrate, and supplied with a back electrode voltage;

a toner source arranged on an opposite side of said substrate from said back electrode, and supplied with a source voltage different from said back electrode voltage, for causing a flow of toner particles from said toner source toward said substrate and said back electrode; and a printhead structure disposed between said substrate and said toner source, said printhead structure comprising (i) an insulating layer having a first side and a second side separated by an elongated slit aperture, said slit aperture having a lengthwise dimension and a widthwise dimension, the lengthwise dimension of said slit aperture extending along said sides and the widthwise dimension of said aperture extending between said sides, and said insulating layer being made of at least one insulating sheet, and (ii) control electrodes disposed only on said first side and along the lengthwise dimension of said slit aperture, said control electrodes being supplied with a first control voltage substantially equal to said source voltage to permit maximum flow of toner particles through said slit or a second control voltage, having polarity with respect to said source voltage which is opposite from said back electrode voltage to stop said flow of toner particles.

2. A direct electrostatic printing device according to claim 1, wherein:

said insulating layer comprises a first insulating sheet and a second insulating sheet, forming said first side and said second side, respectively, of said insulating layer, said first and second insulating sheets each having an elasticity modulus between 0.1 GPa and 10 GPa, inclusive.

3. A direct electrostatic printing device according to claim 1, wherein said elasticity modulus is between 2 GPa and 8 GPa, inclusive.

4. A direct electrostatic printing device according to claim 2, wherein said insulating layer has a thickness between 50 μm and 200 μm, inclusive.

5. A direct electrostatic printing device according to claim 2, wherein said first side and said second side each has a free non-supported length on either side of the slit aperture equal to or greater than 20 mm.

6. A direct electrostatic printing device according to claim 1, wherein said first side of said insulating layer has an edge facing said slit aperture and said second side of said insulating layer has an edge facing said slit aperture, said edge of said first side of said insulating layer and said edge of said second side of said insulating layer having an angle between them of from 0° to 45°, inclusive.

7. A direct electrostatic printing device according to claim 6, wherein said angle is between 0° and 20°, inclusive.

8. A direct electrostatic printing device according to claim 1, wherein said insulating layer has a thickness between 50 μm and 200 μm, inclusive.

* * * * *

UNITED STATES PATENT AND TRADEMARK OFFICE

CERTIFICATE OF CORRECTION

PATENT NO. : 6,109,729

DATED : August 29, 2000

INVENTOR(S) : Desie et al.

It is certified that error appears in the above-identified patent and that said Letters Patent is hereby corrected as shown below:

Column 9, line 41, after "less than" insert -- or equal to--;

Column 16, line 27: "1," should read -- 2, --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*